United States Patent [19]

Wilford et al.

[11] Patent Number: 5,056,692

[45] Date of Patent: Oct. 15, 1991

[54] DISPENSING APPARATUS FOR MOLTEN METAL

[75] Inventors: Colin F. Wilford, Mollington; Norman B. Williams, Shrewsbury, both of United Kingdom

[73] Assignee: The Electricity Counsil and Chamberlin & Hill plc, Walsall, United Kingdom

[21] Appl. No.: 418,207

[22] Filed: Oct. 6, 1989

[30] Foreign Application Priority Data

Oct. 13, 1988 [GB] United Kingdom ..... 8824000
Jul. 17, 1989 [GB] United Kingdom ..... 8916295

[51] Int. Cl.[5] ..... C21C 5/42

[52] U.S. Cl. ..... 222/590; 266/239; 222/593

[58] Field of Search ..... 222/593, 590; 266/209, 266/94, 239, 45, 236

[56] References Cited

U.S. PATENT DOCUMENTS

| | | | |
|---|---|---|---|
| 307,845 | 11/1884 | Curtis | 266/239 |
| 3,572,671 | 3/1971 | Worner | 266/209 |
| 3,653,426 | 4/1972 | Goteke et al. | 266/239 |
| 4,449,568 | 5/1984 | Narasimham | 222/595 |
| 4,668,288 | 5/1987 | Ouchi et al. | 75/49 |
| 4,714,104 | 12/1987 | Ouchi et al. | 266/207 |

FOREIGN PATENT DOCUMENTS

| | | |
|---|---|---|
| 1960283 | 7/1970 | Fed. Rep. of Germany . |
| 2834577 | 2/1980 | Fed. Rep. of Germany . |
| 56-168940 | 12/1981 | Japan . |
| 63-174765 | 7/1988 | Japan . |
| 21976045 | 5/1988 | United Kingdom . |

OTHER PUBLICATIONS

C. F. Wilford, The Electricity Council Research Centre, Chester, England, Research Disclosure, "Heating Molten Metal in a Ladle, Tundish, Furnace, or Similar Vessel," Feb. 1986.

*Primary Examiner*—S. Kastler

*Attorney, Agent, or Firm*—Antonelli, Terry, Stout & Kraus

[57] ABSTRACT

Dispensing apparatus (1) for molten metal or the like comprising a vessel (2) receiving in use a main body (3) of liquid and having dispensing valve means (6, 7) operable to dispense a flow of liquid therefrom, a container (9) defining a chamber (15), means (24) for supporting the container such that an open mouth (16) thereof is immersed in the main body of liquid to define a head space (19) above the liquid in the chamber, suction means (13) connected to the container and operable to reduce pressure in the head space so as to draw liquid from the vessel into the chamber and an induction heating coil (21) operable to heat liquid in the chamber above the level (17) of the main body of liquid, including sensing means (20) sensing the level (17) of the main body of liquid, the sensing means being connected to regulating means (43, 14, 28) operable to regulate the pressure in the head space to thereby regulate the volume of liquid in the chamber such that the level of the main body of liquid is maintained substantially constant during the dispensing of liquid.

14 Claims, 5 Drawing Sheets

DISPENSING APPARATUS FOR MOLTEN METAL

This invention relates to dispensing apparatus for molten metal or the like and in particular but not exclusively to a vessel for dispensing cast iron.

It is known to provide a bottom poured vessel for holding molten metal prior to dispensing for example into individual moulds in a metal casting process. Problems associated with such vessels are that the length of time for which metal can be retained is limited by the rate of cooling from the vessel and also that the rate of dispensing from the vessel tends to decrease as the level of liquid in the vessel is depleted because of the reduced head of liquid above the outlet nozzle. Various adaptations of vessels have been provided for heating the contained liquid but these generally require complex adaptation of the vessel itself and tend to be expensive and inefficient in use. Similarly means have been provided to maintain the level of liquid in the vessel constant during a dispensing operation by supplying to the vessel a compensating flow of liquid from a pressurized and heated container through a pipe extending upwardly into communication with the vessel.

According to the present invention there is disclosed dispensing apparatus for molten metal or the like comprising a vessel receiving in use a main body of liquid and having dispensing valve means operable to dispense a flow of liquid therefrom, a container defining a chamber, means for supporting the container such that an open mouth thereof is immersed in the main body of liquid to define a head space above the liquid in the chamber, suction means connected to the container and operable to reduce pressure in the head space so as to draw liquid from the vessel into the chamber, an induction heating coil operable to heat liquid in the chamber above the level of the main body of liquid, sensing means sensing the level of the main body of liquid, the sensing means being connected to regulating means operable to regulate the pressure in the head space to thereby regulate the volume of liquid in the chamber such that the level of the main body of liquid is maintained substantially constant during the dispensing of liquid.

An advantage of such apparatus is that a constant head of liquid in the vessel can be maintained during operation of the dispensing valve means by returning a compensating flow of liquid to the vessel from the chamber. The flow of liquid dispensed from the vessel is thereby maintained at a constant rate.

A further advantage is that where liquid is to be held in the vessel for an extended period prior to operation of the dispensing valve means the liquid can be heated without the necessity for any adaptation to the vessel itself.

The withdrawn liquid is heated by an induction coil which is located above the vessel and may be external to the container so that in the event of any fracture of the container the withdrawn liquid is automatically returned to the vessel by equalization of air pressure in the head space with minimal risk of heated liquid contacting the induction coil. This is particularly important where the induction coil is a water cooled tube because there is a potential explosion hazard if the tube is contacted by molten metal or the like.

According to a further aspect of the invention there is disclosed a method of dispensing molten metal or the like from dispensing apparatus comprising a vessel, a container defining a chamber, support means for supporting the container such that an open mouth thereof is immersed in the main body of liquid to define a head space above the liquid in the chamber, suction means connected to the container and operable to reduce pressure in the head space so as to draw liquid into the chamber, an induction heating coil operable to heat liquid in the chamber above the level of the main body of liquid, sensing means sensing the level of the main body of liquid, the sensing means being connected to regulating means operable to regulate pressure in the head space, the method including the steps of withdrawing a quantity of liquid into the chamber and operating a dispensing valve means to dispense a flow of liquid from the vessel while regulating the pressure in the head space such that the level of the main body of liquid is maintained substantially constant.

Particular embodiments of the present invention will now be described by way of example only and with reference to the accompanying drawings in which.

Figure 1:
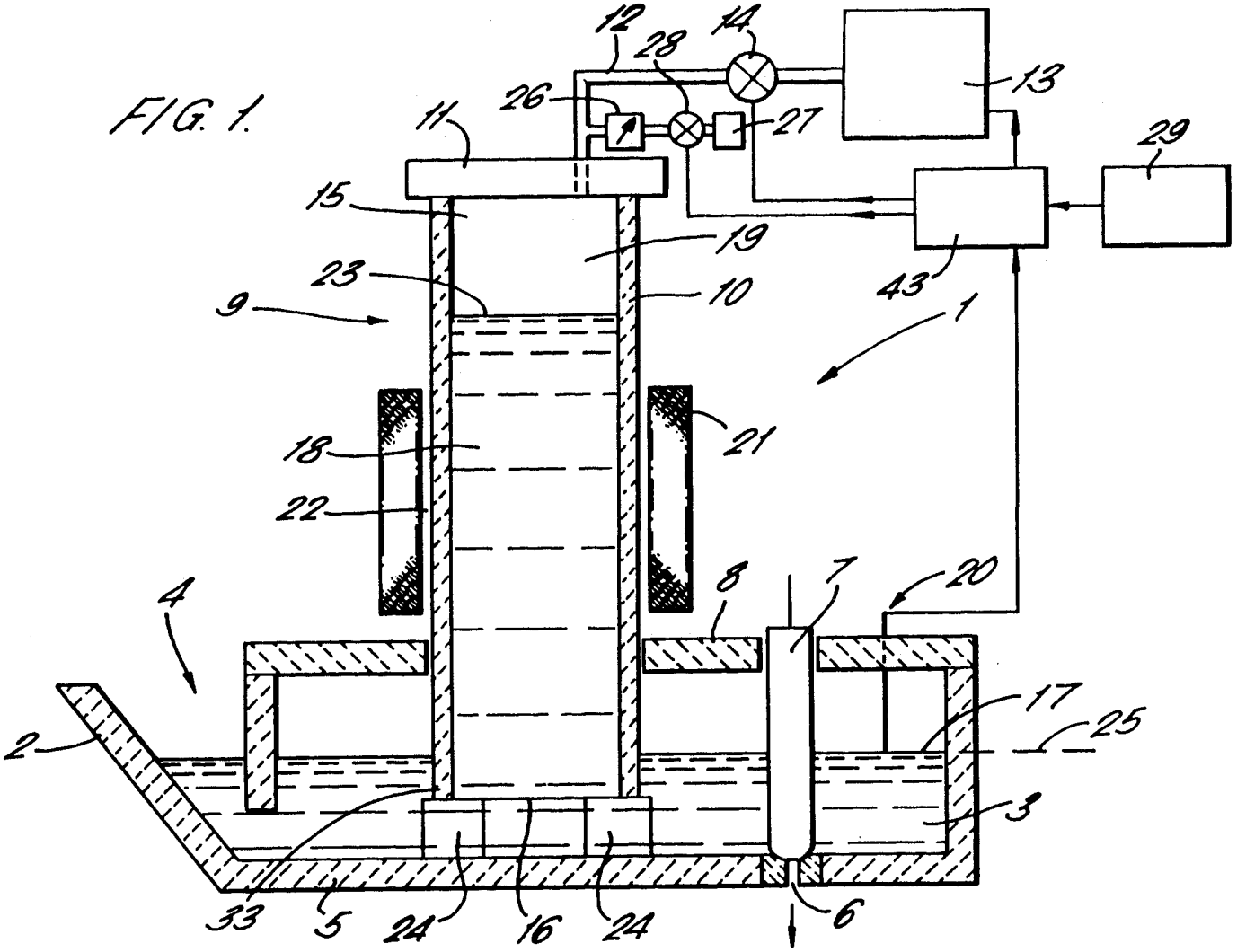
FIG. 1 is a schematic elevation of dispensing apparatus in accordance with the present invention.

In FIG. 1 a dispensing apparatus 1 comprises a vessel 2 receiving a main body 3 of liquid in the form of molten iron delivered to the vessel from a furnace through an inlet 4.

The vessel 2 has a flat bottom 5 having dispensing valve means comprising a dispensing nozzle 6 which is opened and closed by means of a valve member 7. The vessel 2 includes a removable cover 8 and is formed of an insulated refractory material.

A container 9 comprises a refractory tube 10 which extends vertically upwardly from the vessel 2 and rests on supports 24 mounted on the bottom 5. The tube 10 is closed at its upper end by a closure plate 11 which forms an air tight seal therewith. A pipe 12 extends through the closure plate 11 and communicates with a suction pump 13 via a first solenoid actuated control valve 14. The pipe 12 also communicates with atmosphere at an inlet 27 via a second solenoid actuated control valve 28 which is connected in series with a needle valve 26 allowing the flow rate to be accurately controlled.

The container 9 defines a chamber 15. The tube 10 has an open lower end portion 33 defining an open mouth 16 of the container 9 which is immersed beneath the level 17 of the main body 3 of liquid. The chamber 15 is partially occupied by liquid 18 such that the remainder of the chamber is occupied by a head space 19 filled with air which can be evacuated by action of the suction pump 13 and control valve 14.

A liquid level sensor 20 extends downwardly from the cover 8 into contact with the liquid surface 17 in the vessel 2 in order to provide an electrical signal indicating whether the liquid level reaches a predetermined height 25 above the bottom 5.

The sensor 20 is connected electrically to a control unit 43 which in turn is connected electrically for the control of the first and second control valves 14, 28 and the pump 13. The valves 14, 28 and the control unit 43 provide means for regulating the pressure within chamber 15 during dispensing as described below. The control unit 43 is provided with a timer 29 for regulating the operating cycle of the apparatus when heating liquid 18 prior to dispensing as described below.

An induction coil 21 extends coaxially about the tube 10 at a location above the vessel 2 and is separated from the tube by an annular air gap 22. The coil 21 is connected to an electrical power supply (not shown) and is liquid cooled.

In use the vessel 2 is filled with liquid 3 via the inlet 4 from a furnace or the like (not shown) to a level which exceeds the predetermined level 25 indicated by sensor 20. Suction is then applied to the head space 19 by operating the pump 13 and opening the control valve 14 such that air is evacuated by means of the pump 13. Liquid 18 is then drawn into the tube 10 until the level 17 of the main body of liquid 3 coincides with the predetermined level 25 as sensed by the sensor 20. The valve 14 is then closed under control of the control unit 43. In this static position as shown in FIG. 1 the level 23 of liquid 18 within the container 9 is above the level 17 in the vessel 2 and is such that withdrawn liquid 18 extends through the induction coil 21.

To dispense liquid from the vessel 3 the valve member 7 is raised to open the nozzle 6 so that a flow of liquid is dispensed.

During dispensing the control unit 43 is set to operate in a dispensing mode in which the first control valve 14 remains closed and the second control valve 28 is opened and closed in a controlled manner to admit air to the chamber 15 at a rate limited by needle valve 26. When the level 17 of the main body of liquid makes contact with the sensor 20 the control unit 43 reacts by closing the second control valve 28. When the level 17 falls out of contact with the sensor 20 the control unit reacts by commanding the second control valve 28 to open thereby admitting a flow of air regulated by the needle valve 26 into the chamber 15 such that liquid 18 is partially returned to the main body 3 of liquid. When the level 17 again makes contact with the sensor 20 the second control valve 28 is again closed. In this way the level 17 is maintained substantially at the predetermined level 25.

The apparatus thereby provides a constant head of liquid in the vessel 2. Since the flow rate of dispensed liquid is determined by the head of liquid 3 above the nozzle 6 it is thereby possible to obtain a substantially constant dispensed flow rate. The advantage of having a constant dispensed flow rate when pouring liquid into a mould is that the quantity of liquid dispensed is proportional to the duration of the flow. A uniform shot weight can therefore be dispensed in successive dispensing operations by timing each dispensing operation to have the same duration.

During extended periods between dispensing operations it is necessary to compensate for heat losses from the vessel 2 by supplying heat to the liquid 3. The dispensing apparatus 1 is able to provide such heating by means of the induction coil 21. The induction coil 21 is actuated to heat the withdrawn liquid 18 by induction currents within the liquid itself whilst providing a flow of cooling liquid within the induction coil to prevent the coil from overheating. Since the coil is located above the vessel 3, the heating effect of the coil is substantially confined to the withdrawn liquid 18.

The valve 28 is then opened to admit air to the head space 19 thereby returning the withdrawn liquid 18 to the vessel 2. The returned liquid rapidly disperses amongst the main body 3 of liquid thereby raising the overall liquid temperature.

During extended periods between dispensing operations the control unit 43 is set to operate in standby mode in which liquid 18 is withdrawn, heated and then returned to the main body of liquid repeatedly in a cyclic manner under the control of a timer 29 providing for a two minute period during which liquid 18 is withdrawn followed by a two minute period in which liquid 18 is returned to the main body 3 of liquid. The induction coil 21 remains connected to its power supply throughout each cycle, the amount of energy drawn in inductive heating being dependent on the quantity of metal withdrawn so as to lie within the coil at any given time.

The dispensing apparatus 1 has the inherent fail-safe property that if the refractory tube 10 should fracture whilst liquid 18 is withdrawn then air will be admitted to the tube 10 thereby restoring the pressure of the head space 19 to atmospheric pressure and rapidly returning the withdrawn liquid 18 to the main body of liquid 3. The situation is thereby avoided in which molten metal can escape from the container 9 to come into contact with the induction coil 21. The potentially dangerous situation in which molten metal comes into contact with cooling fluid within the induction coil 21 is thereby avoided.

The tube 10 may be removed for cleaning, repair or replacement by vertically lifting the tube from the vessel 2 and conveniently the induction coil 21 may remain in situ. Similarly the induction coil 21 may be removed without disturbing the tube 10.

The cover 8 of the vessel 2 may be removed to facilitate cleaning of the vessel. The apparatus 1 is therefore inherently simple to maintain and provides high accessibility for inspection, cleaning and maintenance of its components.

The apparatus 1 may be used for heating and dispensing zinc, aluminum, iron and other metals including magnesium treated iron for spheroidal graphite. The simple construction allows an existing vessel to be modified by the addition of the container and induction coil at minimal expense. Moreover, the dispensing apparatus in accordance with the present invention is ideally suited to situations where the same vessel is to be used for a number of different grades of metal since the vessel 2 is of simple shape and can be rapidly emptied and cleaned therefore when required.

Figure 2:
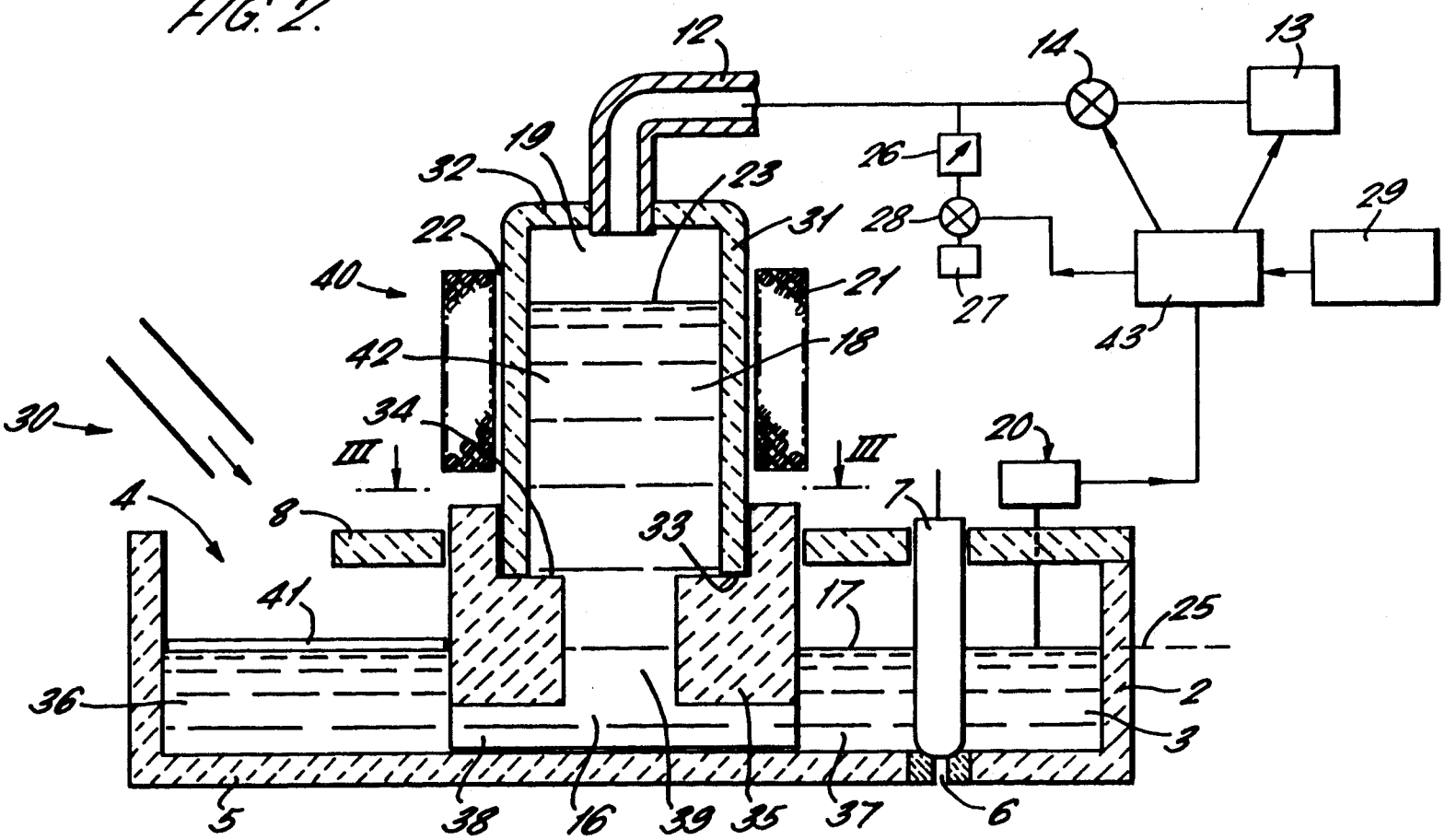
FIG. 2 is a schematic elevation of an alternative dispensing apparatus.
Figure 3:
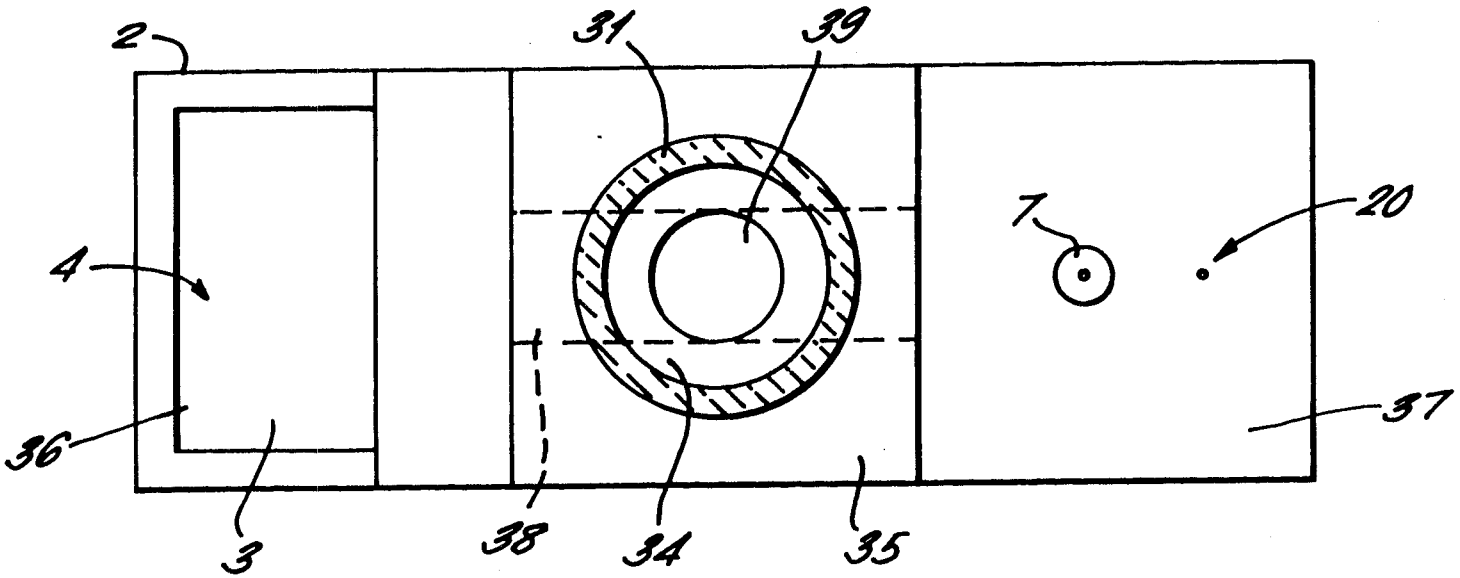
FIG. 3 is a schematic plan view of the apparatus of FIG. 2.

Alternative dispensing apparatus 30 is shown in FIGS. 2 and 3 where reference numerals corresponding to those of FIG. 1 are used where appropriate for corresponding elements.

Apparatus 30 has a modified refractory tube 31 having an integrally formed upper end closure 32 which is bored to receive a pipe 12. The pipe 12 is sealed to the end closure 32 and is connected to a suction pump 13 via a first control valve 14 and also to atmosphere at an inlet 27 via a second control valve 28 and a needle valve 26.

The tube 31 has a lower end portion 33 which is sealed into a recess 34 formed in a support member comprising a shaped block 35 of refractory material. The block 35 rests on the bottom 5 of the vessel 2 and supports the tube 31 in an upright position in which it extends upwardly of the vessel 2. The vessel 2 is of a rectangular cross-section as seen in plan view in FIG. 3 and the block 35 is located centrally in the vessel and extends the full width of the vessel so as to divide the vessel into first and second portions 36 and 37 respectively.

The block 35 is formed with a horizontally extending tunnel 38 communicating between the first and second portions 36 and 37 at a height which is well below the normal level 17 of the main body of liquid 3.

The block 35 also includes a vertical bore 39 communicating between the recess 34 and the tunnel 38.

The block 35 and the tube 31 together comprise a container 40 defining a chamber 42 having a mouth 16 defined at the junction of the bore 39 with the tunnel 38. The mouth 16 is located beneath the level 17 of the main body of liquid 3 in its normal position at which it is maintained at a predetermined level 25.

The lower end 33 of the tube 31 is located at a level which is above the predetermined level 25.

Molten metal is poured into the first portion of the vessel 2 through an inlet 4 and any slag 41 which may collect on the liquid surface and any turbulence resulting from the pouring in of liquid is confined within the first portion 36 by the presence of the block 35. The liquid surface within the second portion 37 is thereby maintained substantially free of any slag and turbulence.

An automatic control unit 43 is connected to the control valves 14 and 28 and to the suction pump 13 and also receives signals from the liquid level sensor 20. The control unit 43 is arranged in its dispensing mode to turn on and off the second control valve 28 during dispensing of liquid through the dispensing nozzle 6 so as to maintain a substantially constant head of liquid in the vessel 2.

In use the vessel 2 is charged with liquid through inlet 4 and liquid flows from the first portion 36 into the second portion 37 through the tunnel 38. Liquid is drawn into the chamber 42 by turning on the suction pump 13 with the first control valve 14 in the open position such that the level 23 of liquid within the chamber rises above the level 17 of the main body 3 of liquid in the vessel 2.

Prior to dispensing liquid from the vessel the liquid may be heated if required. Liquid 18 partially occupying the chamber 42 may be heated by energizing the water cooled induction coil 21 and the heated liquid may then be returned to the main body of liquid 3 by opening the second control valve 28 with the first control valve 14 being turned off. The returned liquid rapidly disperses amongst the main body of liquid 3 thereby raising the overall liquid temperature to compensate for any loss in temperature due to cooling from the vessel 2.

During extended periods between dispensing operations the apparatus 30 may be operated in standby mode as described above with reference to the apparatus 1 of FIG. 1.

Prior to dispensing liquid from the vessel 2 a quantity of liquid equal to or greater than the quantity to be dispensed is withdrawn into the chamber and the pressure in the head space 19 is adjusted until the level 17 of the main body 3 of liquid corresponds to the predetermined level 25.

During the dispensing of liquid from the nozzle 6 by raising of the valve member 7 the withdrawn liquid 18 is returned to the main body of liquid 3 by the controlled admission of air through the valve 28 to the head space 19 under the control of the control unit 43. The returned liquid flows through the vertical bore 39 into the tunnel 38 to replenish liquid withdrawn from the main body of liquid 3.

In this way a constant head of liquid can be maintained in the vessel 2, the level being maintained at a predetermined level 25 as measured by the liquid level sensor 20.

The flow of air through valve 28 may alternatively be manually controlled.

In this arrangement the lower end portion 33 of the tube 31 is exposed to less thermal shock than in the case of the embodiment of FIG. 1 and is also less susceptible to erosion from contact with molten metal since only the internal surfaces of the tube are contacted by liquid.

The use of an integrally formed upper end closure of the tube 31 is simpler, cheaper and more reliable than the arrangement of FIG. 1. The mass of liquid metal that can be lifted within the chamber 42 is limited by the availability of stock sizes of refractory tube 31 and in practice this limit is about 250 Kg which corresponds to a tube of 200 mm diameter.

Figure 4:
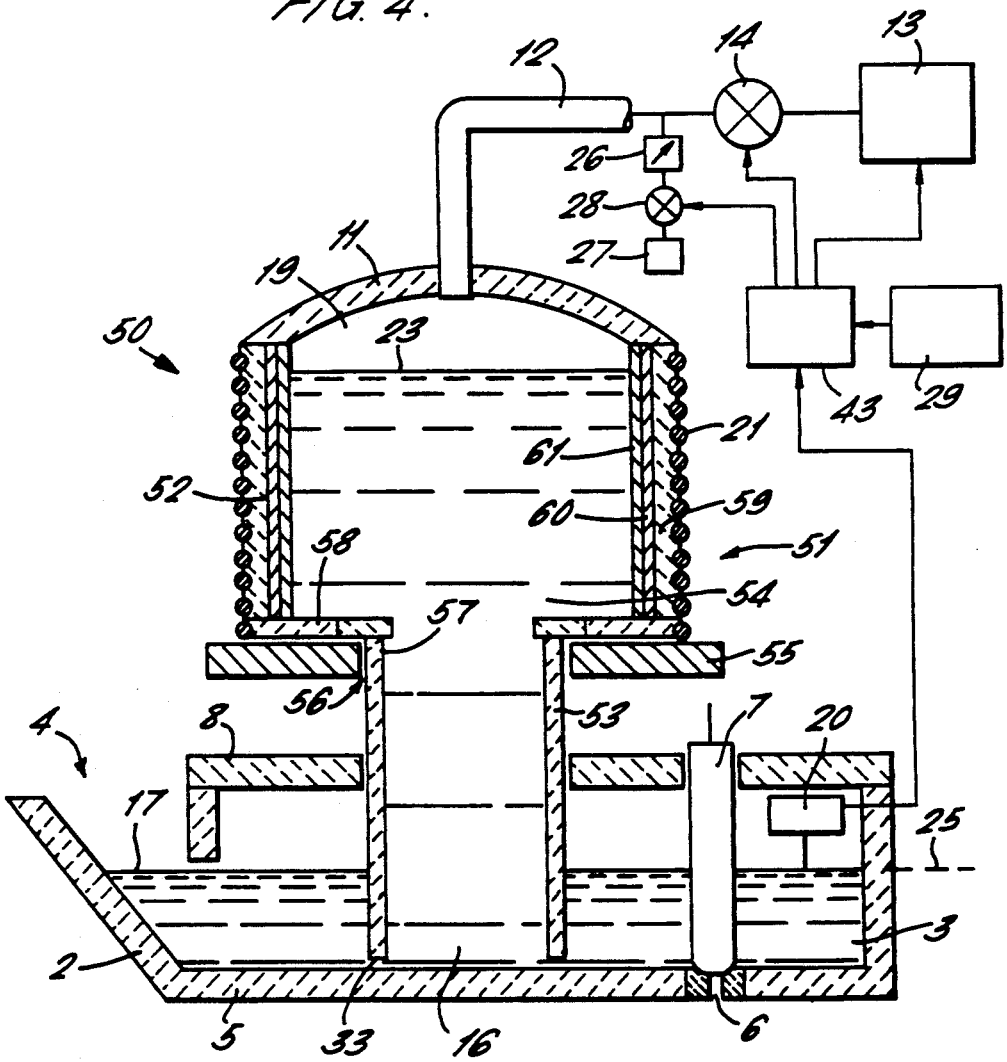
FIG. 4 is a schematic elevation of a further alternative dispensing apparatus and FIG. 5 is a schematic elevation of a further alternative dispensing apparatus.

The further embodiment of FIG. 4 is intended to enable a greater mass of liquid to be lifted within the chamber so that a greater mass of liquid can be dispensed in a single operation of the valve means 6, 7. An alternative dispensing apparatus 50 is shown in FIG. 4 where corresponding reference numerals to those of previous Figures are used where appropriate for corresponding elements.

Apparatus 50 includes a container 51 comprising a furnace portion 52 to which is connected a depending tubular portion 53. The container 51 defines a chamber 54 and has a mouth 16 defined by a lower end 33 of the tubular portion 53 which is located in a vessel 2 so as to be normally immersed in a main body 3 of liquid contained in the vessel.

The furnace portion 52 is supported above the vessel 2 by an annular support 55 defining an aperture 56 through which the tubular portion 53 depends.

The tubular portion 53 is formed from a tube of refractory material and has an upper end 57 which is sealed to a base plate 58 of the furnace portion 52.

The furnace portion 52 is of greater diameter than the tubular portion 53, the diameter being determined by the required volume of chamber 54 necessary for lifting the required mass of liquid to be supplied in a single operation to the vessel 2.

Whereas the tubular portion 53 is constructed from a proprietary tube of refractory material, the furnace portion 52 has in this example a diameter of 0.5 m and is made in situ as described below.

A helical induction coil 21 is supported on the support 55 and refractory material in the form of alumina paste is applied to the coil so as to form a cylindrical lining 59 within the coil. The lining 59 is allowed to set by drying in air and a further slip layer 60 of ceramic fibre is inserted within the lining 59. Finally an inner cylindrical layer 61 is added in the form of a dry silica powder which is rammed into position and sintered by gradually warming metal in the furnace by applying heat using the coil 21.

A closure plate 11 is sealed to the upper end of the furnace portion 52 and bored to receive a pipe 12 which connects the chamber 54 to a suction pump 13 via a control valve 14.

Operation of the apparatus 50 is similar to the operation of apparatus 1 and 30 as described above. In the alternative apparatus 50, however, there is no air gap between the furnace portion 52 and the coil 21 since the refractory material makes contact with at least the innermost surfaces of the coil 21. The furnace portion 52 can be refurbished by renewing the inner layer 61 using rammed refractory powder which is sintered as described above.

Figure 5:
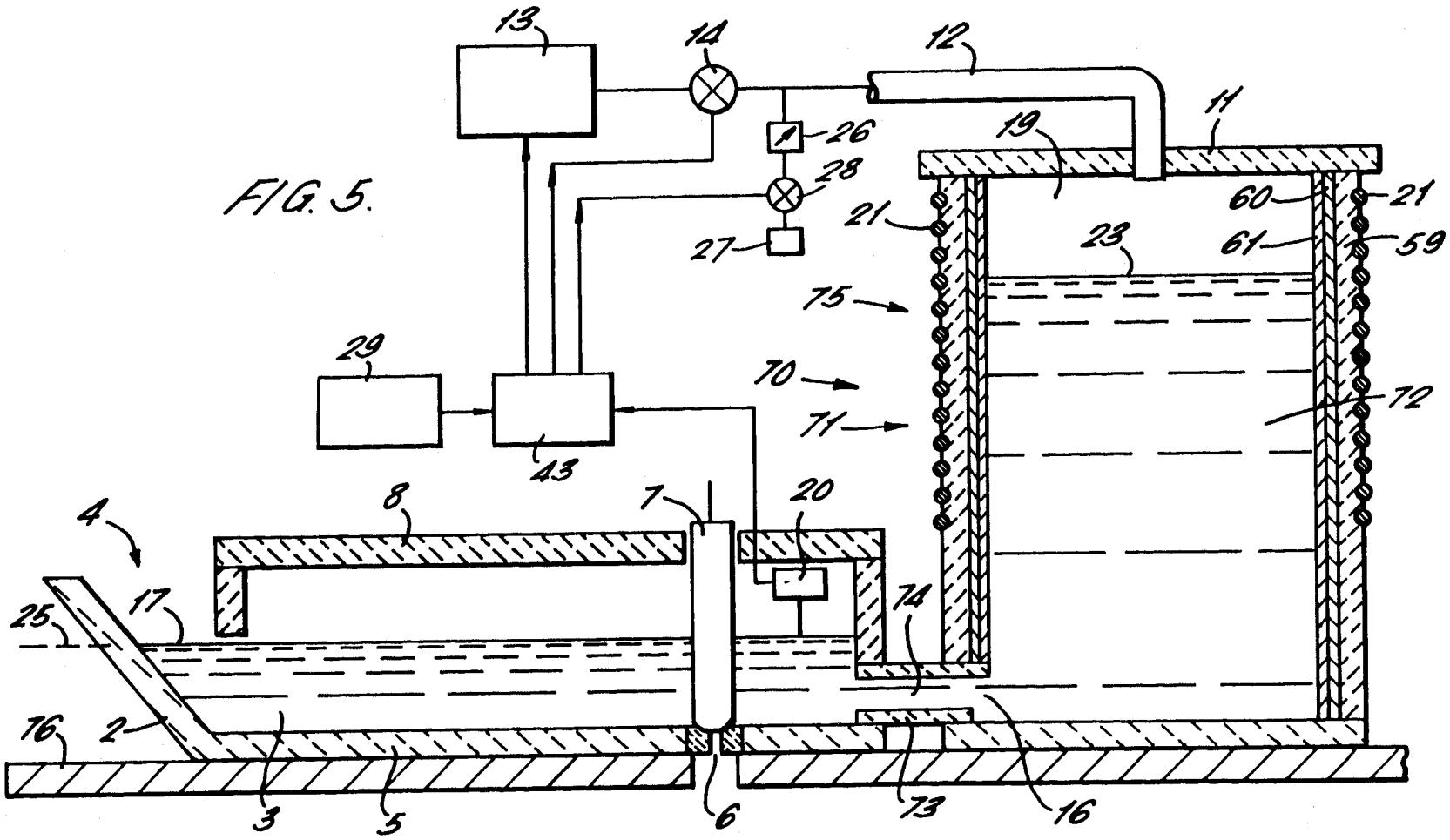

A further alternative apparatus 70 shown in FIG. 5 will now be described with reference to corresponding reference numerals to those used in previous Figures where appropriate for corresponding elements.

The apparatus 70 has a container 71 located to one side of the vessel 2 and defining a chamber 72 communicating with the vessel by means of a horizontally extending tube 73 defining a duct 74. The container 71 comprises a furnace 75 which is constructed in similar manner to the furnace portion 52 of apparatus 50 and includes a coil 21, a cylindrical lining 59, a slip layer 60 and an inner layer 61. The container 71 is closed at its upper end by a closure plate 11 through which a pipe 12 communicates with a suction pump 13 via a control valve 14.

The chamber 72 has a mouth 16 defined by the duct 74 and located such that the level 17 of the main body 3 of liquid within the vessel 2 is normally maintained at the predetermined level 25 which is above the mouth 16.

The furnace 75 can be mounted on the same supporting surface 76 as provided for the vessel 2 thus reducing the overall height of the apparatus.

The dispensing apparatus of any of the above embodiments may additionally be provided with a temperature sensor measuring the temperature of the liquid and the output of the temperature sensor may be used to control the heating of liquid in the standby mode of operation of the apparatus. The extent to which the liquid is heated may be controlled by varying the power input to the heating coil or alternatively by regulating the length of time in each cycle during which liquid is withdrawn into the chamber to be heated by the induction heating coil.

We claim:

1. Dispensing apparatus for molten material comprising:

a vessel for receiving in use a main body of liquid and having dispensing valve means operable to dispense a flow of liquid therefrom;

a container having an open mouth and defining a chamber;

support means for supporting the container such that the open mouth thereof is immersed in the main body of liquid to define a head space above liquid in the chamber;

suction means connected to the container and operable to reduce pressure in the head space so as to draw liquid from the vessel into the chamber;

an induction heating coil operable to heat liquid in the chamber above the level of the main body of liquid;

sensing means for sensing the level of the main body of liquid; and regulating means responsive to the sensing means and operable to regulate the pressure in the head space to thereby regulate the volume of liquid in the chamber such that the level of the main body of liquid is maintained substantially constant during dispensing of the liquid.

2. Dispensing apparatus as claimed in claim 1, wherein the container comprises a refractory tube supported substantially vertically so as to extend upwardly of the vessel.

3. Dispensing apparatus as claimed in claim 2 wherein the refractory tube has a lower end portion defining the mouth of the container.

4. Dispensing apparatus as claimed in claim 2 wherein the support means comprises a support member connected to a lower end portion of the tube and defining the mouth of the container.

5. Dispensing apparatus as claimed in claim 4 wherein the support member partitions the vessel into a first portion having an inlet and a second portion from which liquid may be dispensed by the dispensing valve means and further comprises a tunnel defining a flow path between the first and second portions beneath the normal level of the main body of liquid.

6. Dispensing apparatus as claimed in claim 2 wherein the container further comprises a furnace portion, and wherein the tube has an upper end portion connected to the furnace portion, the furnace portion being of greater cross-section than the tube.

7. Dispensing apparatus as claimed in claim 1 wherein the container comprises a furnace portion located to one side of the vessel and connected to the vessel by connecting means defining the mouth of the container.

8. Dispensing apparatus as claimed in claim 2 wherein the induction heating coil is located above the vessel and the tube extends through the coil and wherein the coil is separated from the tube by an annular air gap.

9. Dispensing apparatus as claimed in claim 1 wherein the regulating means comprises a first valve means connected between the suction means and the chamber and a second valve means connected between the chamber and the atmosphere.

10. Dispensing apparatus as claimed in claim 9 wherein the second valve means comprises a gas control valve operable to admit gas to the head space at a controlled rate.

11. Dispensing apparatus as claimed in claim 1 wherein the regulating means is operable to cyclically draw liquid from the vessel into the chamber and return liquid from the chamber to the vessel to enable heating of the liquid with the induction heating coil prior to dispensing.

12. A method of dispensing molten material from a dispensing apparatus, the dispensing apparatus comprising:

a vessel for receiving in use a main body of liquid and having dispensing valve means operable to dispense a flow of liquid therefrom;

a container having an open mouth and defining a chamber;

support means for supporting the container such that the open mouth thereof is immersed in the main body of liquid to define a head space above liquid in the chamber;

suction means connected to the container and operable to reduce pressure in the head space so as to draw liquid into the chamber;

an induction heating coil operable to heat liquid in the chamber above the level of the main body of liquid;

sensing means for sensing the level of the main body of liquid; and regulating means responsive to the sensing means and operable to regulate pressure in the head space;

the method comprising the steps of:

drawing a quantity of liquid from the vessel into the chamber; and operating the dispensing valve means to dispense a flow of liquid from the vessel while regulating the pressure in the head space such that the level of the main body of liquid is maintained substantially constant.

13. A method as claimed in claim 12 further comprising the step of heating the liquid prior to operation of the dispensing valve means by drawing into the chamber a quantity of liquid from the main body of liquid, heating the liquid from the main body of liquid, heating the liquid drawn into the chamber with the induction heating coil, and returning at least a portion of the heated liquid from the chamber to the main body of liquid prior to operation of the dispensing valve means.

14. A method as claimed in claim 13 wherein liquid is cyclically drawn into the chamber, heated, and returned to the main body of liquid.

* * * * *